US005426877A

United States Patent [19]

Lin

[11] Patent Number: 5,426,877

[45] Date of Patent: Jun. 27, 1995

[54] DYNAMIC LIQUID DISPLAY STRUCTURE

[76] Inventor: Rich Lin, No. 185, Dar Guan Road, Section 2, Panchiao, Taipei Hsien, Taiwan

[21] Appl. No.: 177,773

[22] Filed: Jan. 4, 1994

[51] Int. Cl.[6] ..... G09F 19/00

[52] U.S. Cl. ..... 40/406; 40/409

[58] Field of Search ..... 40/406, 409, 427, 435; 446/267

[56] References Cited

U.S. PATENT DOCUMENTS 4,490,931 1/1985 Fleemin ..... 40/406 X 5,272,604 12/1993 Lin ..... 40/409 X

*Primary Examiner*—Kenneth J. Dorner

*Assistant Examiner*—Cassandra Davis

*Attorney, Agent, or Firm*—Bacon & Thomas

[57] ABSTRACT

Pearl shaped bodies are caused to ascend and descend in a liquid filled container by an electromagnetically driven rotator blade assembly which moves the liquid and bodies upwardly through a pressure robe, after which the bodies may descend downwardly along a spiral glide path encircling the length of the pressure tube.

2 Claims, 3 Drawing Sheets

DYNAMIC LIQUID DISPLAY STRUCTURE

BACKGROUND OF THE INVENTION

Based on the types of conventional liquid decoration now available, there are many models and each features unique mechanisms and means of attractiveness by utilizing a container filled with liquid and a driving mechanism in the lower section of sufficient power to cause the movement of the liquid, thereby resulting in a decoration structure product capable of producing a wide range of varying effects, such as a kind of spiraling liquid decoration that utilizes rotator blades in the lower section to stir a whirlpool which causes the small pearl-like beads suspended in the liquid to move with the whirlpool and produce visual effects, and such as a kind of product that also consists of utilizing rotator blades positioned at the lower portion of the container to churn the illuminated liquid in the container to circulate in a kind of upper and lower cyclic motion, while causing the small fragments in the liquid to float and this kind of product may also have positioned in the container small animated figurines such as Santa Claus placed against a number of background images such as falling snow flakes. The invention herein is also a kind of liquid decoration that has a liquid container and a driving mechanism that moves rotator blades to produce visual effects, but the container structure of the invention herein that produces such visual effects differs from the containers of the aforementioned conventional liquid decorations and features distinctively new innovations.

Therefore, the major objective of the invention herein is to provide a kind of churning rotator blade that spins within the liquid in the container and moves downward and upward, while also causing the suspended pearls to enter into a collector pressure tube and then be propelled from the collector pressure tube, thereby causing each pearl to fall, gliding down along the graduated; spiral path of the collector pressure tube, and resulting in a visual effect of many floating pearls.

Another objective of the invention herein is to provide a kind of electromagnetic coil that induces the movement through the driving mechanism of the rotator blades by utilizing a rotating shaft for the rotator blades in the container, wherein there is an enclosed magnet positioned at certain distance along the rotating shaft and external to the container in juxtaposition with the electromagnetic coil that enables the shaft to rotate without spinning the rotator blades.

SUMMARY OF THE INVENTION

The invention herein is a kind of dynamic liquid pearl decoration structure, consisting of a transparent container and driving mechanism, and inside the aforesaid transparent container and suspended in the liquid are round pearls and a collector pressure tube. Secured onto the outside and along the aforesaid collector pressure tube is a spiral glide path. At the lower end of the aforesaid collector pressure tube is a cone-shaped pearl guide chute and, furthermore, positioned at the lower end of the cone-shaped pearl guide chute is a funnel-shaped pearl collector cup. At the bottom of the transparent container is a liquid housing having an outlet port and an inlet port. The aforesaid inlet port is positioned at the center of the funnel-shaped pearl collector cup, and positioned at a lower end of the aforesaid outlet port lower end is a collector cone. Positioned at the lower end of the collector cone are rotating blades which are rotated by a rotating shaft. Positioned at a certain distance along the lower end of the rotating shaft is a magnet enclosure. Furthermore, positioned at the lower section and outside of the transparent container is a bottom mount that also contains the driving mechanism. The aforesaid driving mechanism mainly includes an electromagnetic coil positioned opposite from the rotator blades in the container on the outside of the rotating shaft, which while under utilization, can directly cause the rotator blades to rotate inside the container without creating any movement of the liquid whatsoever. The liquid is propelled upward by the rotator blades and passes through the liquid collector cone and is pumped through the outlet port into the collector pressure tube. The produced liquid movement also causes liquid in the pearl collector cup to flow and the round pearls inside the collector pressure tube are discharged. Then, the aforesaid round pearls float down back into the pearl collector cup in a continual cyclical process, thereby producing the revolving movement that achieves a dynamic and visual decorative effect.

DETAILED DESCRIPTION OF THE PREFERRED EMBODIMENT

Figure 1:
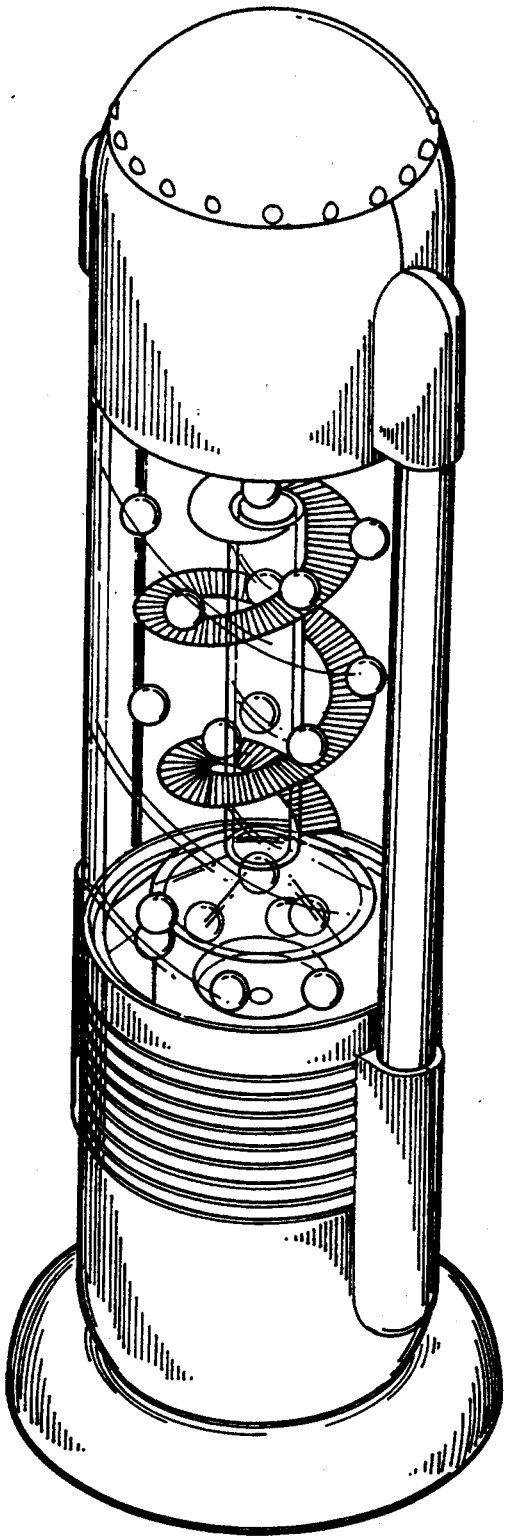
FIG. 1 is an isometric reference drawing of the invention herein.
Figure 2:
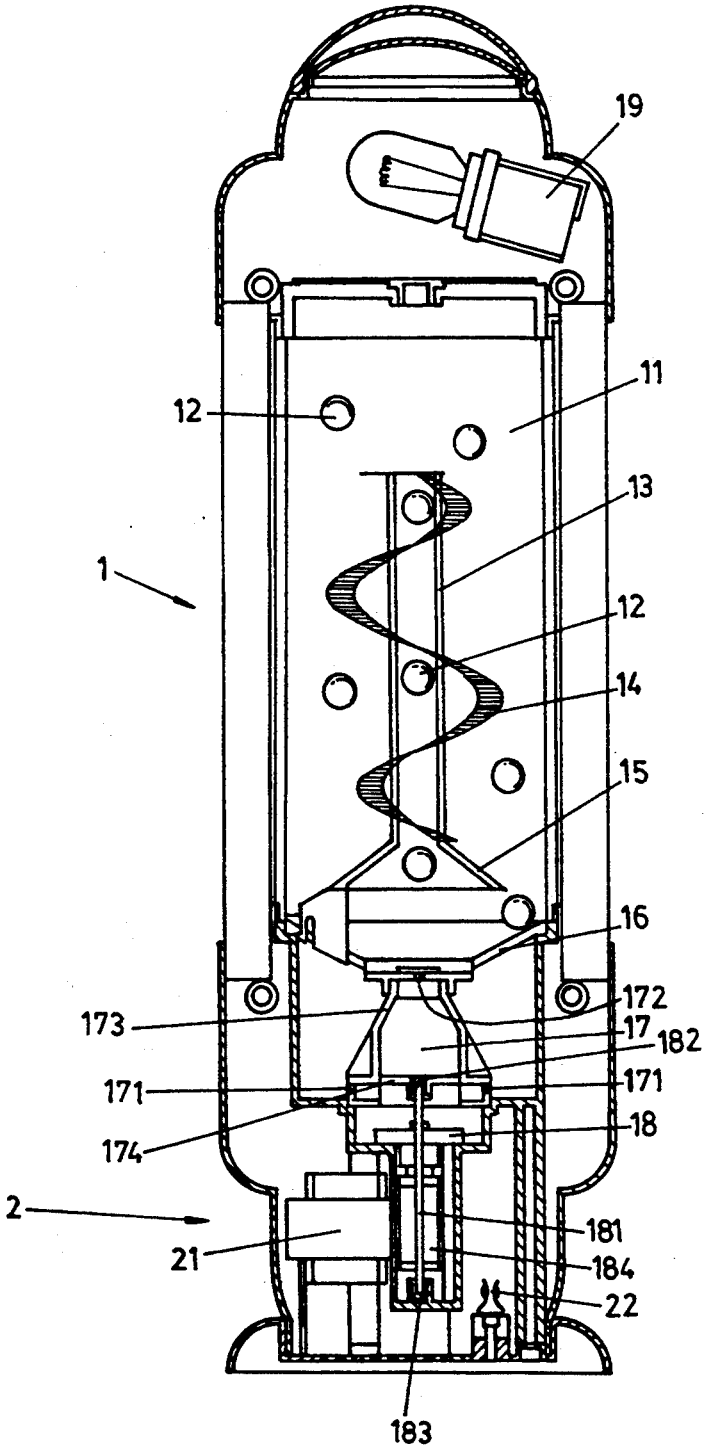
FIG. 2 is a cross-sectional drawing of the invention herein.

First, as indicated in FIG. 1 and FIG. 2, the invention herein is comprised of a transparent container (1) and a driving mechanism (2), wherein the relative position of each component and structural breakdown is described as follows:

The transparent container (1) is filled internally with a transparent liquid (11) and a number of round pearls (12); also inside the container (1) in a centered position is a collector compression tub (13), and around the outside of the aforesaid collector compression tube (13) is a spiral glide path (14) that serves as an accessory fixture; furthermore, at the lower end of the collector compression tube (13) is a cone-shaped pearl guide chute (15), and at the lower end of the pearl guide chute (15) is a funnel-shaped pearl collector cup (16), at the lower end of which is a liquid housing (17) and positioned on the aforesaid liquid housing (17) is an inlet port (171) and an outlet port (172); the aforesaid outlet port (172) is positioned at the center of the funnel-shaped pearl collector cup (16), and positioned at the lower end of the outlet port (172) is a liquid collector cone (173) mechanism extending from the upper external portion of liquid housing (17); at the lower end and center of the liquid housing (17) are the rotator blades (18), and the rotator blades (18) have a rotating shaft, and the rotating shaft (181) is supported at both ends by shaft retainers (182) (183), furthermore, positioned at a certain distance from the lower end of and outside of the rotating shaft (181) is a magnet (184) enclosure that is integrated such that the rotating shaft (181) and the magnet (184) rotate simultaneously; the driving mechanism (2) is positioned at the lower end external to the container (1) and mainly includes an electromagnetic coil (21) and related circuits, such as a fuse (22) and so on; the aforesaid electromagnetic coil (21) is positioned opposite to and around the outside of the rotatable magnet (184), following along with the container shell, and regarding the structural design, the main purpose is to utilize electromagnetic principles, in which the electromagnetic coil (21) is utilized to cause the magnet on the rotating shaft (181) to rotate, when driven by the motor, and since the rotating shaft (181) must be inserted through the container shell and should require the troublesome installation of additional shaft seals, therefore, the structural design of the invention herein eliminates considerations of water leakage.

Figure 3:
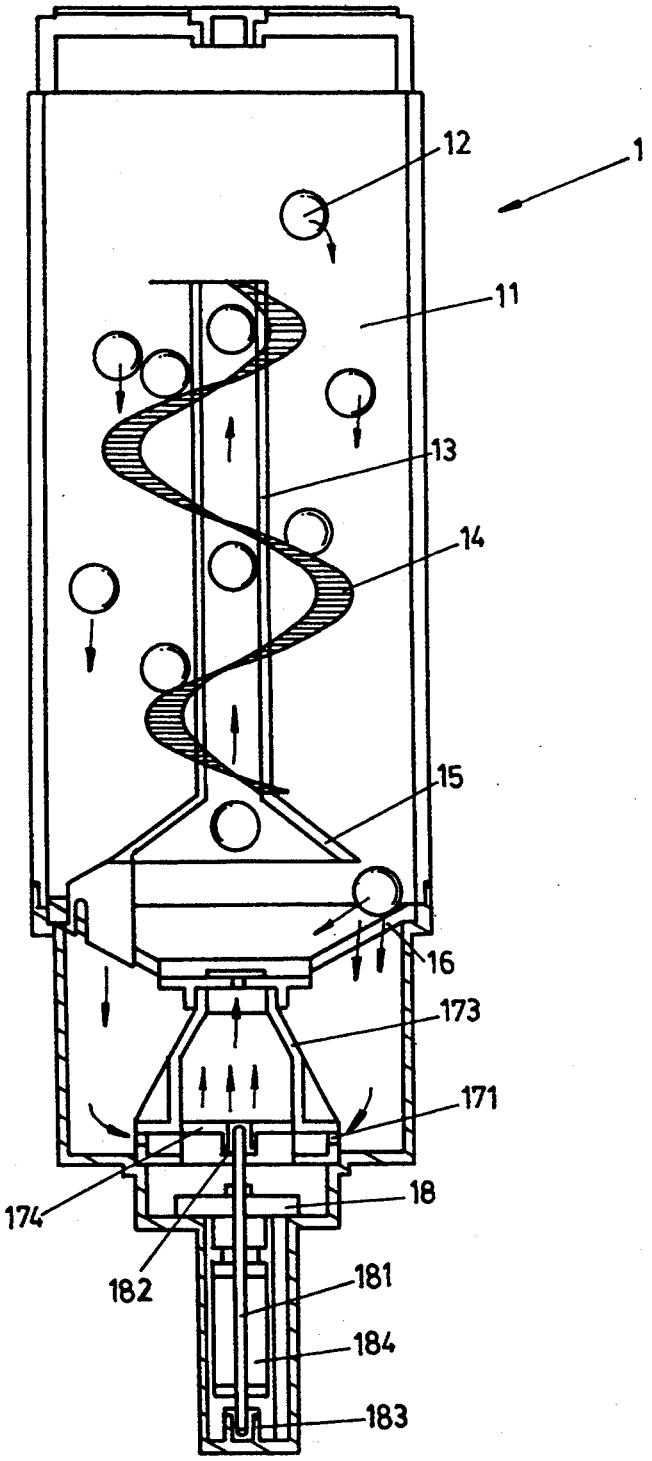
FIG. 3 is a cross-sectional drawing of the container inside the invention herein.

Based on the foregoing structural description, when the invention herein is in a state of rotation, as indicated in FIG. 3, when the driving mechanism (2) is activated, the rotating shaft (181) rotates, the rotator blades (18) inside the liquid housing (17) rotate, the liquid (11) circulates through the inlet port (171) of the liquid housing (17) and flows into liquid housing (17), then circulates to and is discharged from the outlet port (172), and then flows into the collector pressure tube (13), the liquid (11) finally circulates upwards into the collector pressure tube (13) for discharge and thus completes a single cycle; since the flowing liquid (11) causes the simultaneous movement of the round pearls (12), and the round pearls (12) are much heavier in specific weight than the fluid (11), therefore, the round pearls (12) sink, and so the round pearls (12) descend onto the lower portion of the funnel-shaped pearl collector cup (16), or perhaps collide into the pearl guide chute (15), but nonetheless continue to travel downward along the slanted surface and also along the funnel-shaped surface of the pearl collector cup (16) to be collected towards the center; then, the fluid (11) circulated into the liquid housing (17) and flowing through the outlet port (172) propels the round pearls (12) towards the opening at the lower end of the collector pressure tube (13), and since the movement of the fluid (11) meanwhile has a certain degree of current flow and also an unstable degree of current movement, therefore, the cone-shaped pearl guide chute (16) at the lower end of the collector pressure robe (13) directs the round pearls (12) into the collector pressure tube (13), circulating them through the upper end of the collector pressure tube (13) for discharge, and after all of the round pearls (12) are propelled through the upper end of the collector pressure tube (13) by the fluid (11), they sink towards the bottom, or a portion may sink onto the spiral glide path (14) and slide downward, thereafter the round pearls (12) are once again circulated upward through the transparent collector pressure tube (13), and fall once more from the upper end and slide downward along the spiral glide path (14), thereby displaying a range of different visual effects; furthermore, a light bulb (19) can also be added to the upper end to serve as an external illumination source to highlight the color of the resulting visual effects, such that each round pearl (12) has the luster of a real pearl and thus is derived the name of the invention herein.

As also indicated in FIG. 3, the arrows show the direction of the flowing movement of the liquid (11) and the round pearls (12), and as this figure further indicates, the liquid (11) placed in the container (1) and component breakdown of the invention herein can be of the embodiment shown in FIG. 3, wherein the rotator blades (18), rotating shaft (181), magnet (184) and so on, can be positioned inside the container (1), and since the entire electromagnetic coil (21) serving as the electromagnetic source of movement is external to the container (1), therefore it is unnecessary to consider water leakage, thereby precluding the trouble of installing shaft seals and to prevent leakage; furthermore, the tubular channel positioned on the pearl collector cup (16) that facilitates the flow of the liquid (11), specifically the liquid (11) flow from the inlet port (171) into the liquid housing (17) and on pass the rotating shaft (181), the rotating shaft (181) and the shaft retainers (182), consists of a simple structure positioned on a horizontal plate (174) of small surface area, and the aforesaid horizontal plate (174) provides concentrated resistance to the liquid (11) propelled upward by the rotator blades (18); since the preferred embodiment has been structurally described above, there are no technological problems and, therefore, the operational structure of the invention herein is stable, the operating sound is minimal and complies with liquid decoration requirements.

What is claimed is:

1. A dynamic liquid display structure comprising:

a) a transparent container including an upper portion and a lower portion, the container being filled with a liquid of a first specific gravity;

b) a plurality of discrete bodies disposed within the liquid, the bodies being of a second specific gravity that is greater than the first specific gravity to permit the bodies to sink in the liquid;

c) a compression tube vertically positioned within the container and including a top end and a bottom end;

d) a spiral glide path extending around and vertically along the compression tube;

e) a conical guide chute at the bottom end of the compression tube;

f) a funnel-shaped collector cup positioned below the guide chute;

g) a liquid housing positioned below the collector cup and including an inlet port for receiving liquid from the upper portion, an outlet port positioned at the center of the collector cup, and a collector cone extending downwardly from the outlet port;

h) a plurality of rotator blades disposed at a lower portion of the liquid housing; and i) electromagnetic drive means for rotating the rotator blades to circulate the liquid from the inlet port to the outlet port and upwardly through the compression tube along with the bodies towards the upper portion of the container so that the bodies may descend through the liquid and along the spiral glide path.

2. The display structure of claim 1 wherein the electromagnetic drive means includes:

a) rotatable drive shaft, the rotator blades being mounted on the drive shaft;

b) a magnet integrated with the drive shaft for rotation therewith; and c) an electromagnetic coil positioned adjacent the magnet for rotating same.

* * * * *